United States Patent [19]

Brocker

[11] 4,058,103

[45] Nov. 15, 1977

[54] ELECTRONIC IGNITION UNIT

[76] Inventor: Dale C. Brocker, 19525 Forest Ave., Castro Valley, Calif. 94546

[21] Appl. No.: 627,934

[22] Filed: Nov. 3, 1975

[51] Int. Cl.[2] ..... F02P 1/00

[52] U.S. Cl. ..... 123/148 E; 215/209 R

[58] Field of Search ..... 123/148 ND, 148 E, 148 F, 123/148 CB, 146.5 A; 315/209 T; 73/518

[56] References Cited

U.S. PATENT DOCUMENTS

| | | | |
|---|---|---|---|
| 3,161,803 | 12/1964 | Knittweis | 123/148 E |
| 3,280,810 | 10/1966 | Worrell et al. | 123/148 E |
| 3,361,123 | 1/1968 | Kasama et al. | 123/148 E |
| 3,502,955 | 3/1970 | Minks | 123/148 CB |
| 3,549,944 | 12/1970 | Minks | 123/148 CB |
| 3,552,367 | 1/1971 | Slitti | 123/148 E |
| 3,611,813 | 10/1971 | Brocker | 324/173 |
| 3,923,030 | 12/1975 | Luteran | 123/148 E |

*Primary Examiner*—Ronald B. Cox
*Attorney, Agent, or Firm*—Paul B. Fihe

[57] ABSTRACT

An electronic ignition unit which can be installed as a simple replacement for a conventional distributor including a "breakerless" transector for supplying firing pulses in timed sequence to the spark plugs of a conventional internal combustion engine.

4 Claims, 3 Drawing Figures

ELECTRONIC IGNITION UNIT

FIELD OF THE INVENTION

The present invention relates generally to ignition systems for internal combustion engines and more particularly, to an electronic ignition unit which can be employed as a replacement for the distributor and associated parts which supply the appropriate timed voltages to the spark plugs of internal combustion engines.

BACKGROUND OF THE INVENTION

It is of course well known that for a considerable number of years the ignition voltages utilized in the firing of spark plugs in conventional internal combustion engines have been supplied from a "distributor" including switches (breaker points) which are periodically opened and closed mechanically in response to rotation of a rotor in some fashion connected to the engine drive or cam shaft, so that ultimately the desired voltages from an ignition coil are delivered to the spark plugs in appropriate timed sequence.

The electrical and mechanical wear on such "distributor" components has led to the recent development of a number of breakerless "electronic ignition units." More particularly, such electronic units have included units employing electromagnets or photocells. The electromagnetic units are quite expensive and the magnetic fields are gradually distorted resultant from metal particle accumulation so that inaccurate timing results, and obviously the voltage output changes with the speed of rotor revolution. In turn, any particles or liquids (resultant from wear or the environment) produce intermittent or inaccurate timed firing of the photocell units. For whatever reason, such units have themselves introduced additional ignition problems so that as a consequence, the conventional distributor is still used in a majority of engine ignition systems.

SUMMARY OF THE PRESENT INVENTION

Accordingly, it is the primary objective of the present invention to provide an electronic ignition unit which can mechanically and electrically replace a conventional distributor and associated elements to effectively supply the required ignition voltages to the spark plugs of an internal combustion engine over an extended period with minimal electrical or mechanical wear problems, and which preferably can be simply installed as a physical replacement for the conventional distributor.

Briefly, in accordance with one embodiment of the present invention, the stated objective is achieved by providing an electronic ignition unit which includes a housing which is provided with the input of a desired high voltage from an ignition coil for appropriate distribution to the spark plugs of the internal combustion engine, whether it be a four-, six-, or an eight-cylinder engine. More particularly, the distribution is achieved by appropriate contacts connected to a rotary switch on a rotor which is in turn connected to the engine or cam shaft to provide correlated motion therewith in a fashion similar to that of a conventional distributor. Specifically, in accordance with the present invention, the rotor shaft also mounts the rotor portion of what shall be generally denominated as a "transector" which constitutes an insulated base supporting a conductor having a predetermined cyclical pattern in a disposition adjacent but not electrically or physically contacting a stator taking the form of a fixed electrical conductor in a similar cyclical pattern substantially as shown and described in U.S. Pat. No. 3,611,813. A source of low voltage as supplied from the conventional battery or generator associated with the internal combustion engine energizes an oscillator whose output is delivered to the stator section of the transector. The transector output is detected and provides low voltage pulses which are delivered in timed sequence to a high voltage amplifier switch which in turn controls the delivery of high voltage to the primary of the ignition coil (transformer) existent in association with the engine for ultimate delivery of the necessary high voltage pulses to the spark plugs. Associated control circuitry controls and limits the spark plug voltage application to the desired amounts and times and the entire unit can be of relatively small dimensions so as to be housed in a volume no larger than existent engine distributors and can furthermore utilize the existent electrical connections so that a layman with no understanding of the electrical or mechanical functions of an internal combustion engine can replace the existent distributor with the present unit without difficulty.

DETAILED DESCRIPTION OF THE EXEMPLARY EMBODIMENT OF THE INVENTION

Figure 1:
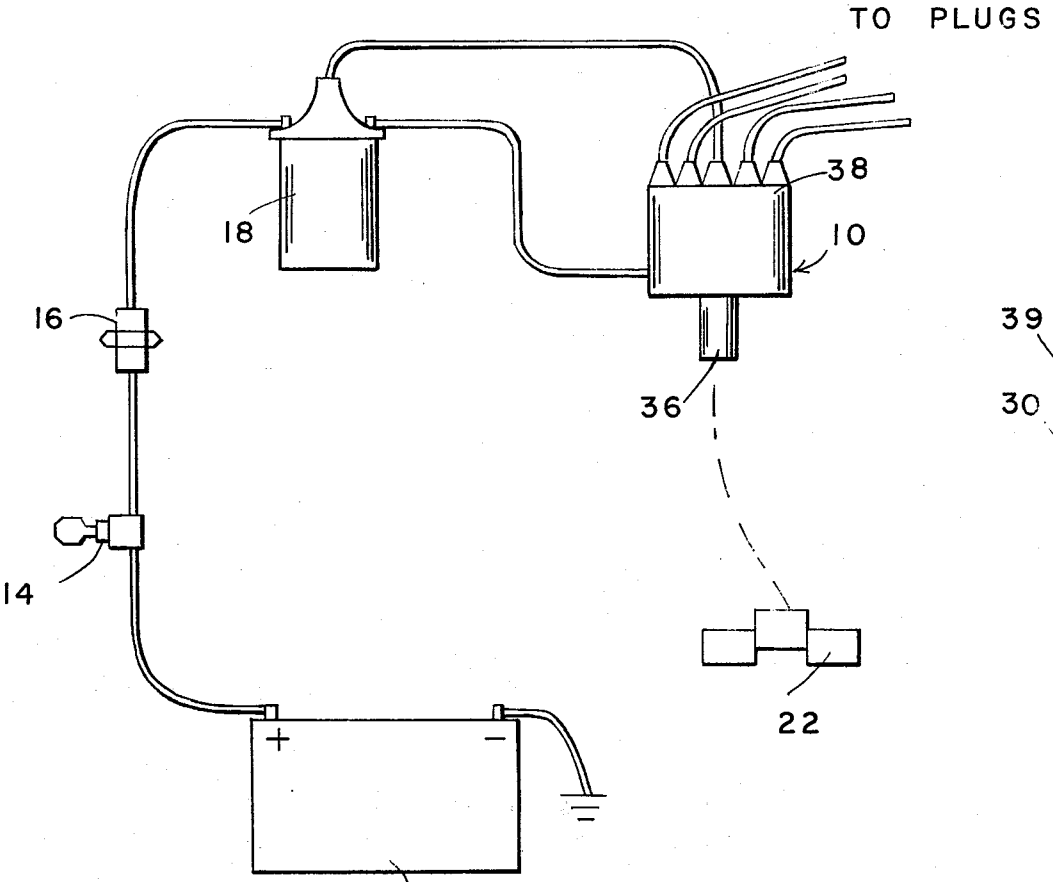
FIG. 1 is a diagrammatic view of an ignition system for an internal combustion engine and incorporating an electronic ignition unit embodying the present invention.

With initial reference to FIG. 1, the electronic ignition unit 10 embodying the present invention is arranged for connection mechanically and electrically in the ignition system of an internal combustion engine in a generally conventional fashion. More particularly, as illustrated, a source of low direct current voltage such as a battery 12 has one terminal grounded while the other terminal is connected through the existent ignition switch 14 and a limiting resistor 16 through the primary of the existent ignition coil 18 to the electronic ignition unit 10.

As will be explained in detail hereinafter, low voltage pulses are generated in the electronic ignition unit 10 and delivered to the ignition coil 18 whose high voltage output is delivered to a rotary switch 20 in the electronic ignition unit 10 which distributes the required high voltage pulses in timed sequence to the spark plugs, the step of the sequence being in part determined by mechanical or other connection to the engine crank shaft 22 so that the required timing of the spark plug pulses is assured. It will be seen from a casual glance at FIG. 1 that the electronic ignition unit 10 embodying the present invention both physically and functionally constitutes a replacement for the conventional distributor and it is capable of design so as to be contained in a similar housing 38 with similar mechanical and electrical connections so that any auto mechanic or layman can readily substitute the new unit embodying the present invention for the conventional distributor without having any knowledge of engine operation or electronics. In particular, it is notable that the connections to the ignition coil and plugs are conventional, and that but one wire connection to the electronic ignition unit 10 is required.

As will be apparent to those skilled in the art, if the physical dimensions of the electronic package are appropriately designed for insertion in the existing distributor housing and cap, a simple removal of the existent rotor, breaker points and condenser will enable substitution of the electronic package in the existent distributor housing. Furthermore, if the electronic ignition unit of the present invention were to be installed as initial equipment rather than as a standard distributor replacement, alternative mechanical and electrical connections can be made while utilizing the same electronic principles which will become more apparent from the following description of the operation of the electronic arrangement shown in FIG. 3.

Figure 3:
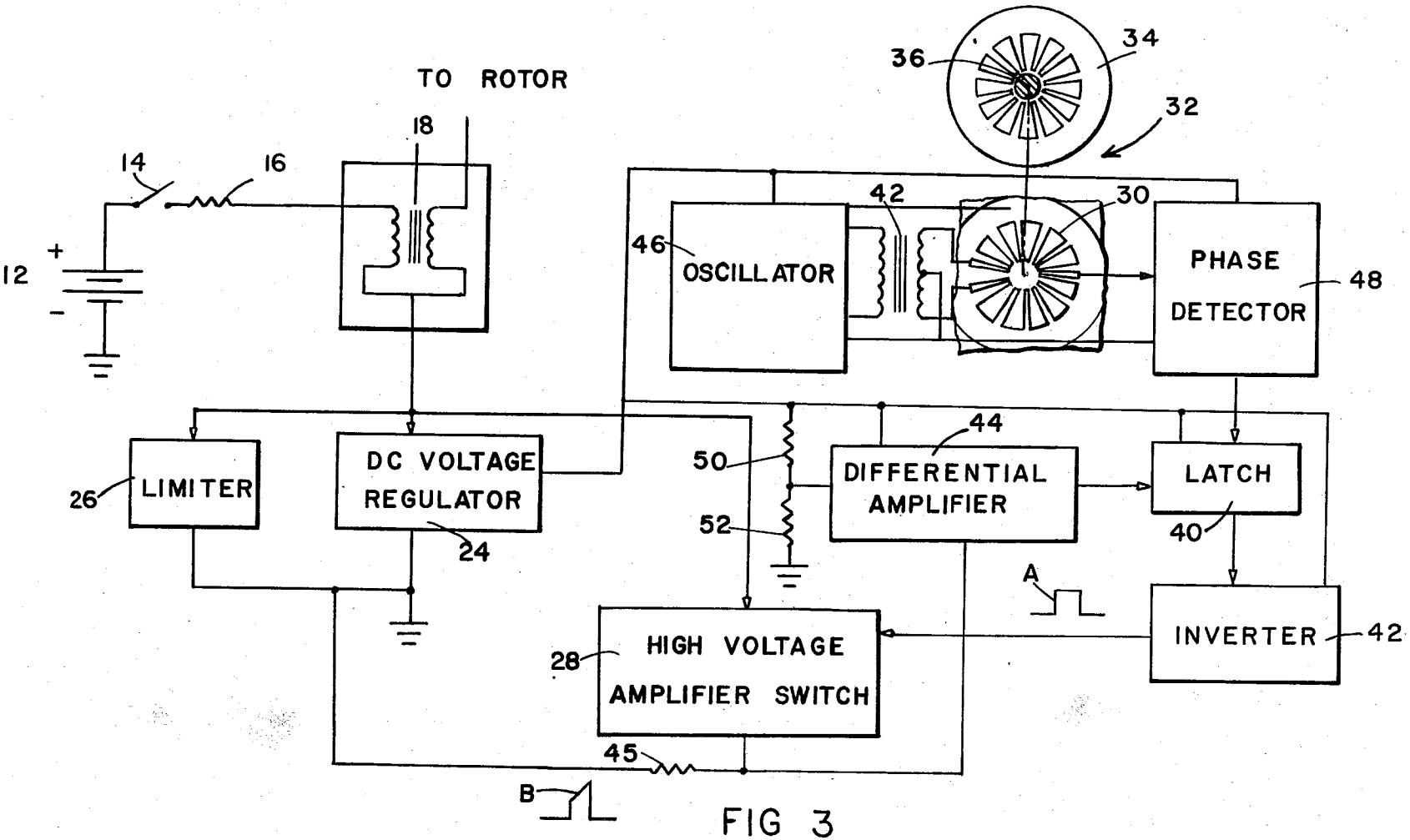
FIG. 3 is an electrical block diagram of the particular embodiment of the invention shown in FIG. 1.

As shown in FIG. 3, the output of the battery 12 is delivered through the ignition switch 14, when closed, the limiting resistor 16 and the primary of the ignition coil 18 to a direct current voltage regulator 24 associated with a voltage limiter 26 to control transients and a high voltage amplifying switch 28. A controlled voltage from the regulator 24 energizes an oscillator 46 whose output is coupled by a transformer 42 to the fixed stator 30 forming part of a "transector" 32 which is the electrical equivalent of the first embodiment of the unit shown in U.S. Pat. No. 3,611,813 that is capable of delivering an output pulse at a position which is correlated with the position of a second section of the transector which shall be denominated the rotor 34 and is specifically connected to the rotor shaft 36 of the electronic ignition unit which is arranged appropriately for mechanical connection to the engine crankshaft 22. The precise details for such mechanical connection form no part of the present invention and will vary depending upon the design of the particular engine with which the electronic ignition unit 10 is to be utilized.

Figure 2:
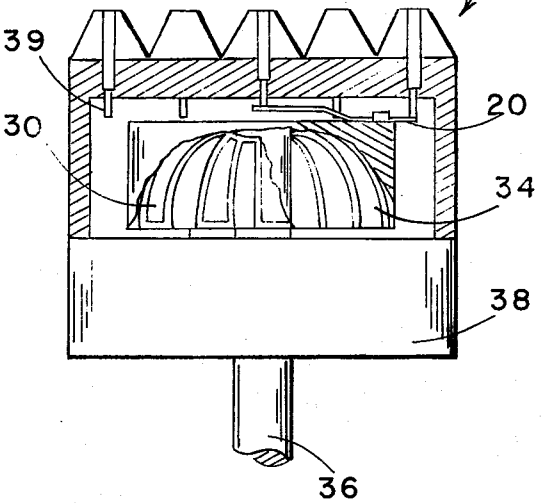
FIG. 2 is an enlarged fragmentary side elevational view of the electronic ignition unit with parts broken away to show interior details.

Specifically, the stator portion 30 of the transector 32 constitutes a cyclical conductor pattern which is formed on the exterior of an inverted insulating cup mounted from the exterior housing of the electronic ignition unit as best indicated in FIG. 2. The rotor portion 34 of the transector 32 is in turn physically mounted on the interior of an inverted cup-shaped insulator whose center is supported on the rotor shaft 36 so that its motion is correlated with that of the crankshaft of the engine. The rotary switch 20 is secured to the top of the rotor 34 so that sequential connection to the output contacts 39 in the cap of the housing and connected to the spark plugs is provided. As explained in detail in the previously referred to U.S. Pat. No. 3,611,813, the rotation of the rotor 34 will generate an output from the transector 32 which is detected by a phase detector 48 to provide an output in the form of a series of short direct current pulses (square waves) at a frequency determined by the speed of the rotor shaft 36. The leading edges of the pulses provides the position information and the spacing therebetween will of course be determined by the speed of rotation of the rotor shaft, and as a consequence, that of the engine shaft, and it will be understood that the particular cyclical pattern will be determined by the number of spark plugs in the engine; four, six, or eight being common examples.

The output of the transector 32 is basically a square wave which is delivered to an electronic latch 40 which commences to fire providing a negative output pulse which is then inverted by a conventional inverter 42. The leading edge of the positive pulse indicated at A from the inverter turns on the high voltage amplifying switch 28 which is connected to the primary of the ignition coil 18. Since the ignition coil primary is principally inductive in nature, the instant the switch 28 turns on, the current is relatively small but rises in substantially a linear fashion as indicated by the wave form B across resistor 45. When this voltage reaches a sufficient value relative to a reference voltage developed across resistors 50, 52 in a differential amplifier 44 connected to the latch 40, it functions to reset the latch to prepare the same for the subsequent input signal from the transector. This, in turn, removes the input to the high voltage switch 28 and allows the field in the core of the ignition coil 18 to collapse thus in the normal fashion to generate a high voltage spike in the ignition coil secondary which in turn is applied through the rotary switch 20 to a selected one of the spark plugs. It will be observed that the time required to reach the requisite level of primary current is always small relative to the period between the required firing of the spark plugs and, as a consequence, the firing voltage (primary current) is not primarily dependent on engine speed.

Various modifications and or alterations in this structure specifically described can be envisioned within the scope of the present invention and accordingly the foregoing description of one embodiment is to be considered as purely exemplary and not in a limiting sense and the actual scope of the invention is to be indicated only by reference to the appended claims.

What is claimed is:

1. An electronic ignition unit for an internal combustion engine having a drive shaft, spark plugs, an associated ignition coil and source of low voltage current which comprises a transector having adjacent but non-contacting rotor and stator, each with electrically-interacting cyclical-pattern conductors thereon, means for electronically connecting said transector stator conductor with the low voltage source, means for mechanically connecting said transector rotor with the engine drive shaft so as to produce a sequence of output pulses, a high voltage switch connected to receive the output pulses generated by said transector in response to rotation of said transector rotor, and adapted to generate a timed sequence of pulses for delivery to the ignition coil, means including an electronic latch and a latch-controlling differential amplifier for controlling the period of the pulse application to said high voltage switch, and a distributing switch electrically connected to said ignition coil for distribution of high voltage pulses in sequence to the engine spark plugs.

2. An electronic ignition unit according to claim 1 which comprises a voltage regulator connected to control the amplitude of the voltage from the low voltage source to said transector stator.

3. An electronic unit according to claim 1 which comprises a voltage limiter associated with said regulator for controlling the amplitude of voltage applied to said transector stator.

4. An electronic ignition unit according to claim 1 wherein said transector rotor physically mounts said distributing switch.

* * * * *